US008104114B2

(12) United States Patent
Ton

(10) Patent No.: US 8,104,114 B2
(45) Date of Patent: Jan. 31, 2012

(54) DISPOSABLE LINER FOR A BASIN

(76) Inventor: Quy That Ton, Baton Rouge, LA (US)

( * ) Notice: Subject to any disclaimer, the term of this patent is extended or adjusted under 35 U.S.C. 154(b) by 0 days.

(21) Appl. No.: 12/471,025

(22) Filed: May 22, 2009

(65) Prior Publication Data

US 2009/0271922 A1 Nov. 5, 2009

Related U.S. Application Data

(63) Continuation-in-part of application No. 12/115,620, filed on May 6, 2008, now abandoned.

(60) Provisional application No. 61/055,253, filed on May 22, 2008.

(51) Int. Cl.
*A47K 1/06* (2006.01)

(52) U.S. Cl. ..... 4/655

(58) Field of Classification Search ..... 4/580–583, 4/585, 622, 655, 657
See application file for complete search history.

(56) References Cited

U.S. PATENT DOCUMENTS

| | | | | |
|---|---|---|---|---|
| 5,465,436 | A * | 11/1995 | Bleicher | 4/580 |
| 2004/0237185 | A1* | 12/2004 | Zolotnik | 4/580 |
| 2007/0000054 | A1* | 1/2007 | Fanuzzi | 5/606 |
| 2008/0276365 | A1 | 11/2008 | Ton | |

OTHER PUBLICATIONS

Beleva LLC; Disposable Liner Refills; http://www.belava.com/p-4-disposable-liner-refills.aspx.

* cited by examiner

*Primary Examiner* — Huyen Le
(74) *Attorney, Agent, or Firm* — Next IP Law Group LLP

(57) ABSTRACT

Embodiments of a disposable liner that is disposed in a cavity of a basin are disclosed. In one embodiment, a disposable liner that is disposed in a cavity of a basin includes sidewalls that are designed to adapt to the contours of the cavity of the basin and a bottom wall that is attached to the sidewalls and includes a drainage hole that is aligned with the drainage hole of the basin. The disposable liner further includes a cover that seals the drainage holes, preventing water from draining out of the disposable liner through the drainage hole. The cover includes an elongated tab that extends to a top edge of at least one of the side walls. The elongated tab is designed to facilitate peeling the cover off the disposable liner.

5 Claims, 5 Drawing Sheets

DISPOSABLE LINER FOR A BASIN

CROSS-REFERENCE TO RELATED APPLICATION

This application is a continuation in part of U.S. utility application entitled, "DISPOSABLE LINER FOR A BASIN," having Ser. No. 12/115,620, filed May 6, 2008, which claims priority to copending U.S. provisional application entitled, "DISPOSABLE LINER FOR A BASIN," having Ser. No. 60/916,427, filed on May 7, 2007, and claims priority to U.S. provisional application entitled, "DISPOSABLE LINER FOR A BASIN," having Ser. No. 61/055,253, filed May 22, 2008, both of which are entirely incorporated herein by reference.

TECHNICAL FIELD

This disclosure relates to a basin, and more particularly to a disposable liner that is disposed inside a cavity of a basin.

BACKGROUND

In the pedicure industry, a foot tub is used to rinse and clean a person's foot. However, a person's foot typically has bacteria, fungus, and other related organisms that contaminate the foot tub after using the foot tub. The contaminated foot tub can contaminate another person's foot if the foot tub has not been properly sanitized or cleaned.

SUMMARY

Embodiments of a disposable liner that is disposed in a cavity of a basin are disclosed. In one embodiment, a disposable liner that is disposed in a cavity of a basin includes sidewalls that are designed to adapt to the contours of the cavity of the basin and a bottom wall that is attached to the sidewalls and includes a drainage hole that is aligned with the drainage hole of the basin. The disposable liner further includes a cover that seals the drainage holes, preventing water from draining out of the disposable liner through the drainage hole. The cover includes an elongated tab that extends to a top edge of at least one of the side walls. The elongated tab is designed to facilitate peeling the cover off the disposable liner.

Other apparatuses, methods, features, and advantages of the present disclosure will be or become apparent to one with skill in the art upon examination of the following drawings and detailed description. It is intended that all such additional apparatuses, methods, features, and advantages be included within this description, be within the scope of the present disclosure, and be protected by the accompanying claims.

BRIEF DESCRIPTION OF THE DRAWINGS

Many aspects of the disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views.

DETAILED DESCRIPTION

Disposable liners are disclosed herein. One function of the disposable liner, among others, is to prevent the spread of infections in a basin, and more particularly, a basin of a pedicure spa. There have been many cases of bacterial infections during a pedicure service due to the inconsistent mixing of the disinfectant products or by not using the disinfectant products at all. The disposable liner is designed to eliminate the transfer of bacteria within the pedicure spa.

For example, when a customer is ready to get a pedicure, a nail technician can place a disposable liner into the basin of the pedicure spa. Fresh water is poured into the new liner to ensure cleanliness and hygiene. After a nail technician completes a customer's pedicure, the contaminated water is disposed of by lifting a heat sealed foil cover (approximately 1.5 inch hole) at the bottom of the disposable liner.

Once drained, the liner is discarded and the inner surface of the basin is sanitized with, for example, Crosstex™ disinfectant wipes (Hospital Grade and EPA Approved). When another pedicure customer is ready, a new disposable liner is used. Once the foil has been removed, the disposable liner generally can not be reused due to the fact that the hole is sealed with a heat sealed foil, preventing multiple uses of the liner and bacteria infections to the customers.

Figure 1:
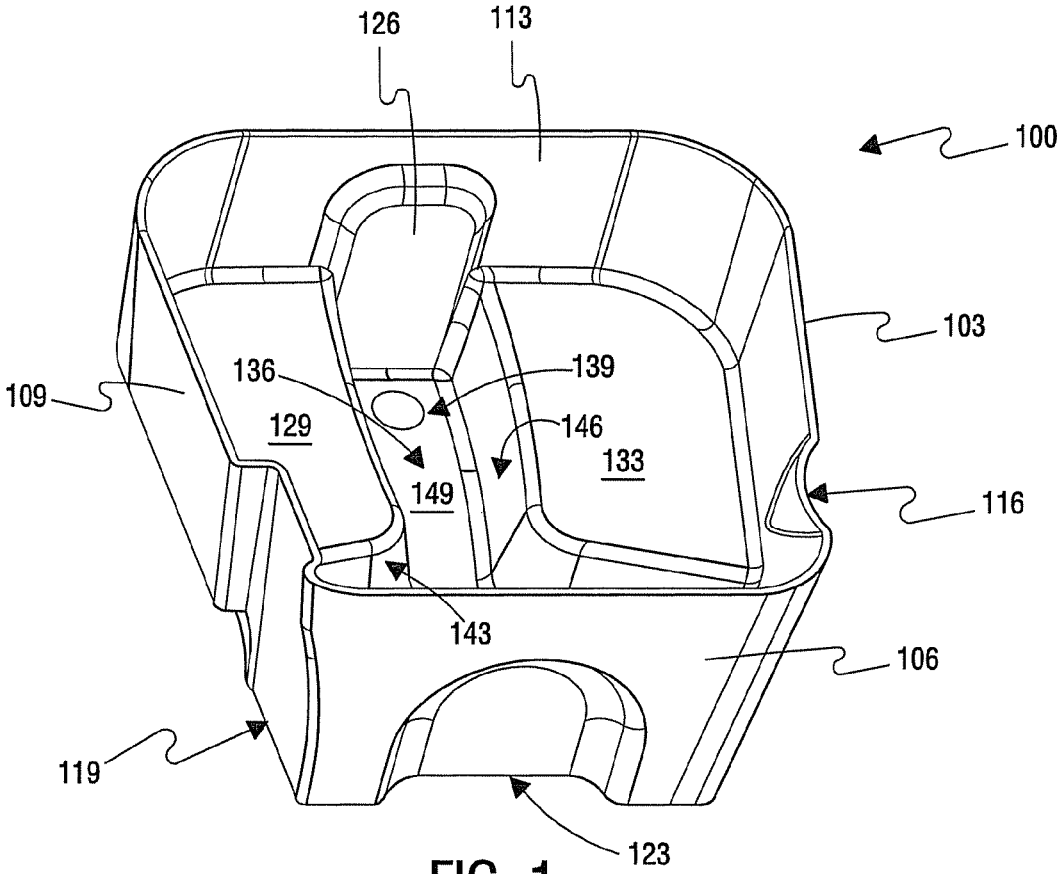
FIG. 1 is perspective view of a disposable liner that is placed in a cavity of a basin or foot tub.
Figure 6:
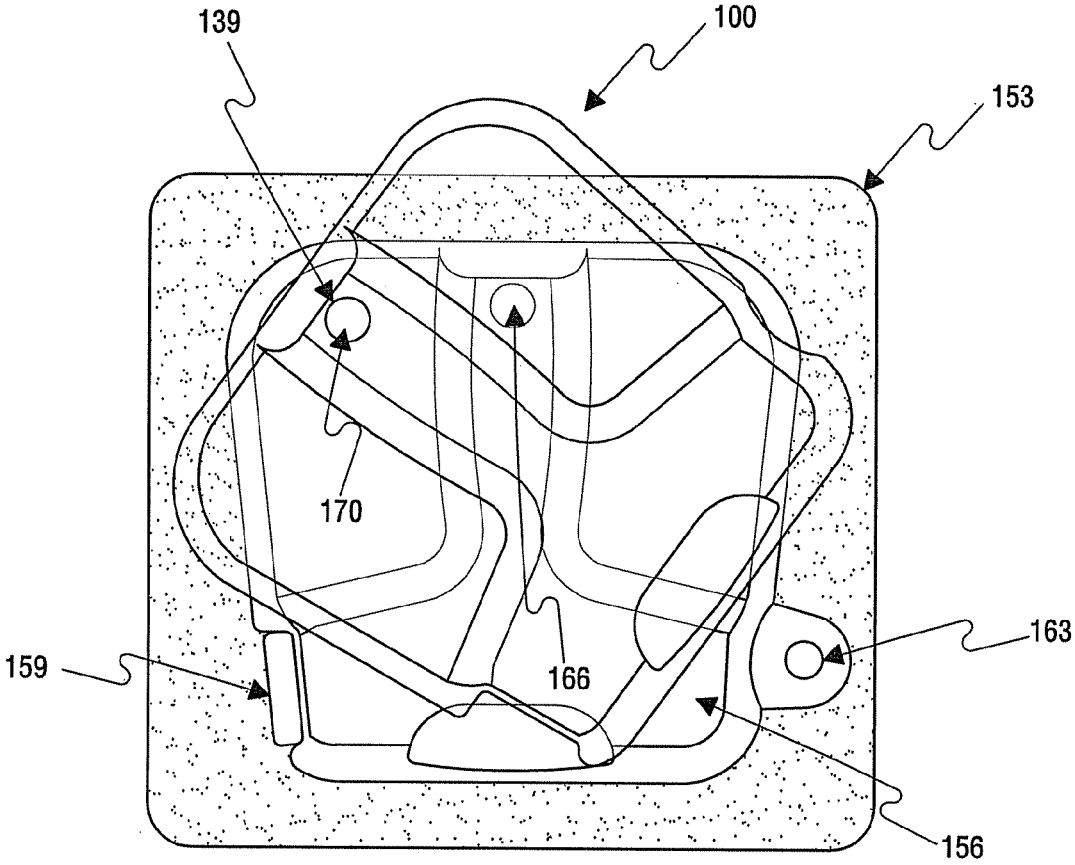
FIG. 6 is a perspective view of a disposable liner, such as that shown in FIG. 1, resting at an angle along the peripheral of a basin.

FIG. 1 is perspective view of a disposable liner 100 that is placed in a cavity 156 (FIG. 6) of a basin or foot tub 153 (FIG. 6). The disposable liner 100 includes sidewalls 103, 106, 109, and 113, which include indentations 116, 119, 123, 126, respectively, for adapting to the contours of the cavity of the basin 153, which is described and shown in FIGS. 6 and 7. The sidewalls 109,113 are attached in a normal position to a foot rest 129 and the sidewalls 103, 113 are attached in a normal position to another foot rest 133. Between the two foot rests 129, 133 is a trench 136. Such trench 136 includes sidewalls 143, 146, both of which are attached in a normal position to the foot rests 129, 133, respectively. Both sidewalls 143, 146 of the trench 136 are attached in a normal I position to the bottom wall 149 of the trench 136. The bottom wall 149 of trench 136 includes a drainage hole 139 adjacent to the sidewall 113.

Figure 2:
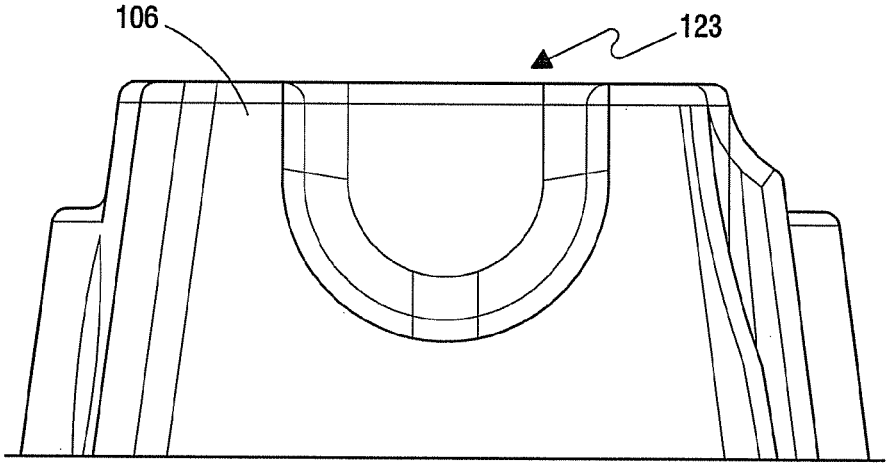
FIG. 2 is a front view of a disposable liner, such as that shown in FIG. 1, in which the disposable liner is upside down.
Figure 3:
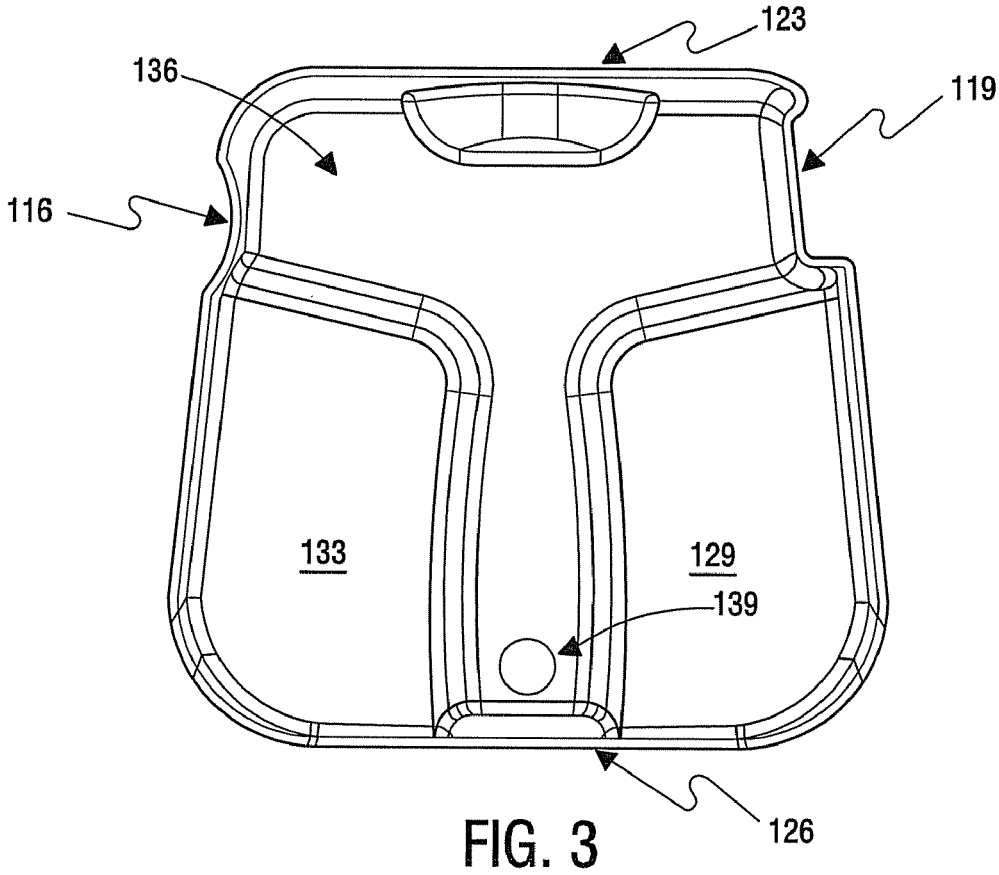
FIG. 3 is a top view of a disposable liner, such as that shown in FIG. 1.
Figure 4:
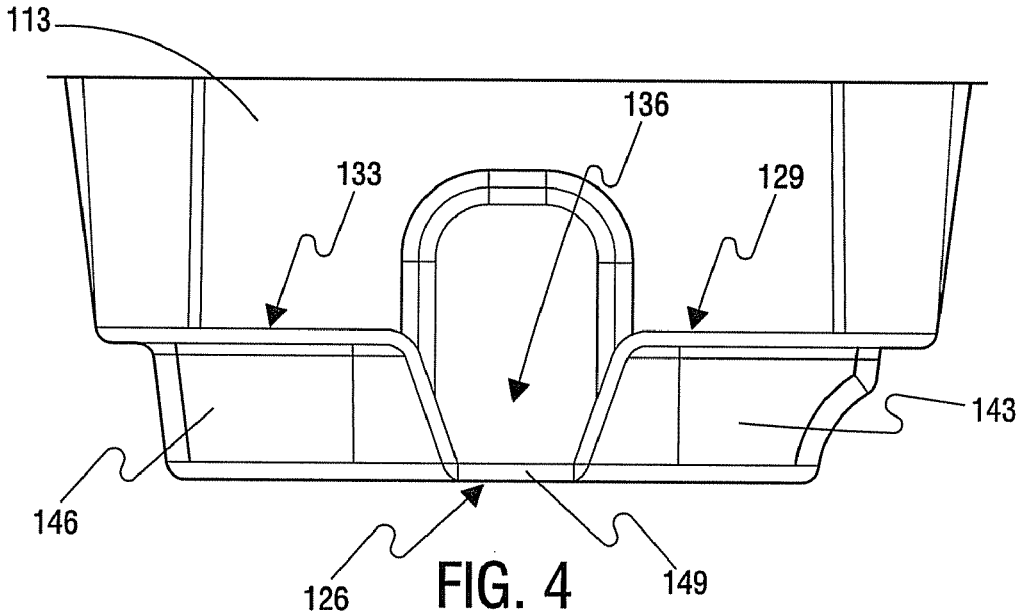
FIG. 4 is a rear view of a disposable liner, such as that shown in FIG. 1, having a sidewall with indentation.

FIG. 2 is a front view of the disposable liner 100, such as that shown in FIG. 1, in which the disposable liner 100 is upside down. The front view shows the sidewall 106 and the indentation 123. FIG. 3 is a top view of the disposable liner 100, such as that shown in FIG. 1. FIG. 4 is a rear view of the disposable liner 100, such as that shown in FIG. 1, having the sidewall 113 with the indentation 126. The bottom portion of the sidewall 113 is attached in a normal position to the foot rests 129, 133. The foot rests 129, 133 are attached in a normal position to the sidewalls 143, 146 of the trench 136. The bottom portion of the sidewalls 143, 146 of the trench 136 is attached in a normal position to the bottom wall 149 of the trench 136.

Figure 5:
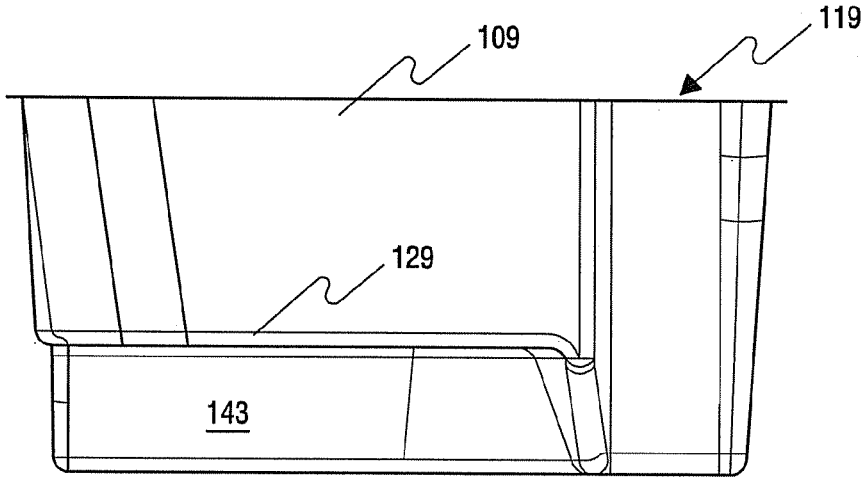
FIG. 5 is a side view of a disposable liner, such as that shown in FIG. 1, having a sidewall having indentation.

FIG. 5 is a side view of the disposable liner 100, such as that shown in FIG. 1, having the sidewall 109 having the indentation 119. The bottom portion of the sidewall 109 is attached in a normal position to the foot rest 129, which is attached in a normal position to the sidewall 143 of the trench 136.

FIG. 6 is a perspective view of the disposable liner 100, such as that shown in FIG. 1, resting at an angle along the peripheral of the basin 153. In general, the disposable liner 100 is molded to adapt to the shape of the interior of the basin 153. For example, the indentations 116, 119 of the sidewalls 103, 109 adapt to the shape of the basin 153 having an overflow structure 159 and a shower head portion 163, respectively.

The basin 153 includes a cavity 156 in which the disposable liner 100 is disposed therein. The cavity 156 includes a basin hole 166 at the bottom wall of the basin 153. The disposable liner 100 includes a cover 170 that seals the drainage hole 139 of the disposable liner 100, preventing water from draining out of the disposable liner 100 through the drainage hole 139. The cover 170 includes, but not limited to, a heat sealed foil that is further described in relation to FIGS. 7 and 8. The drainage hole 139 is generally aligned with the drainage hole of the basin 153.

Figure 7:
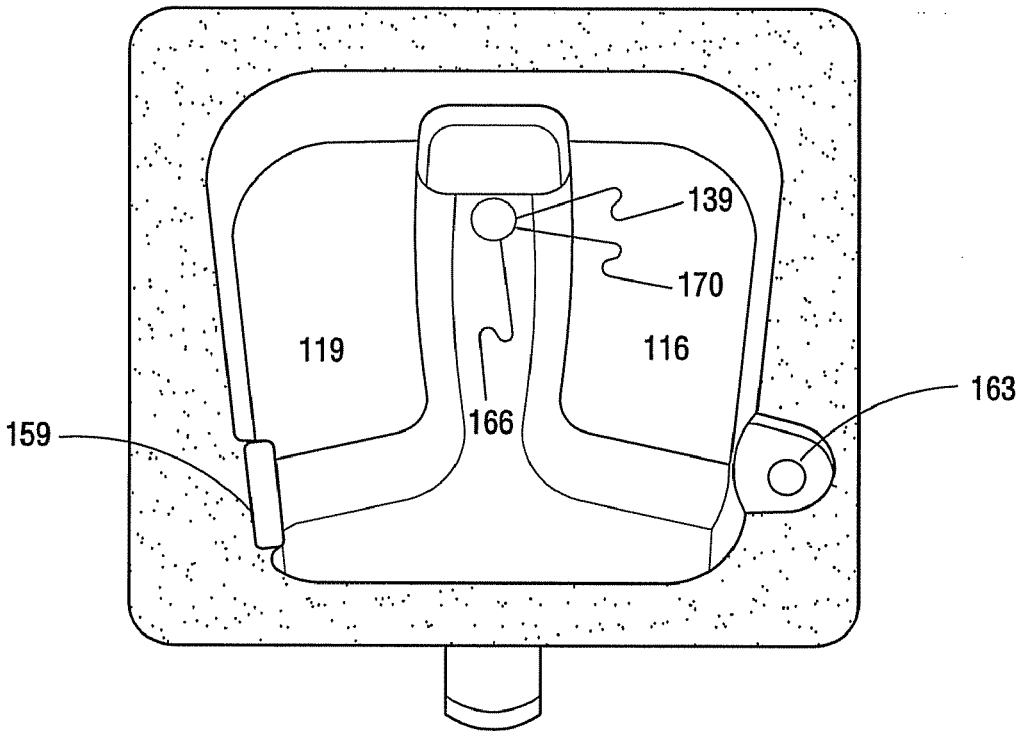
FIG. 7 is a top view of a disposable liner, such as that shown in FIG. 1, being disposed inside a cavity of a basin.

FIG. 7 is a top view of the disposable liner 100, such as that shown in FIG. 1, being disposed inside the cavity 156 of the basin 153. The indentations 116, 119 of the sidewalls 103, 109 are adapted to shape of the overflow structure 159 and shower head portion 163. The heat sealed foil 170 of the disposable liner 100 is placed on top of the drainage hole 139. The drainage hole 139 has a diameter of approximately 1.5 inches. The heat sealed foil 170 is a non-contact method of heating a metallic disk to hermetically seal the drainage hole 139 using an induction sealing method.

In general, the heat sealed foil 170 is multi-layered. For example, a top layer of the heat sealed foil 170 can be made of paper pulp. The next layer can 6 be made of wax that is used to bond a foil to the pulp. The bottom layer can be made of a polymer film laminated to the foil. The disposable liner 100 passes under an induction coil, which emits a varying electromagnetic field. As the disposable liner 100 passes under the induction coil (also known as a sealing head) the conductive aluminum foil liner begins to heat. The heat melts the wax, which absorbs into the pulp backing and releases the foil from the disposable liner 100. The polymer film also heats and flows onto the peripheral of the drainage hole 139. When cooled, the polymer creates a bond with the disposable liner 100 resulting in a hermetically sealed product.

Figure 8:
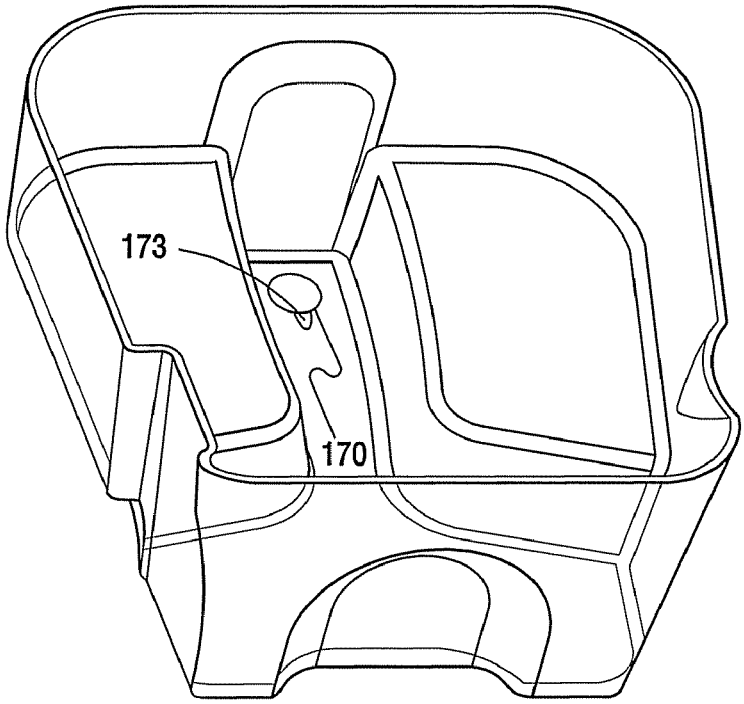
FIG. 8 is a perspective view of a disposable liner such as that shown in FIG. 1, having a tab on a heat sealed foil.

FIG. 8 is a perspective view of the disposable liner 100 having a tab 173 on the heat sealed foil 170. A user can use the tab 173 to facilitate peeling the heat sealed foil 170 off the disposable liner 100. An exemplary process of using the disposable liner 100 is as follows. The disposable liner 100 is placed inside the cavity 156 of the basin 153. The disposable liner 100 is then filled with water using the shower head portion 163.

A person's foot is placed inside the liner to be properly rinsed and cleaned. After the rinsing and cleaning are completed, the heat sealed foil 170 is peeled off the disposable liner 100 using the tab 173 draining the water out of the disposable liner 100 through the drainage hole 139 into the basin hole 166. The disposable liner 100 is then thrown away. A new and uncontaminated disposable liner 100 can be used to rinse and clean the next person's foot. This reduces the chances of bacterial and fungus contamination from one person's foot to another person's foot. 7

Alternatively or additionally, to prevent reuse of a disposable liner, the heat sealed foil is coated with a substance that changes color when the heat sealed foil is exposed to water. This ensures the next person to a certain degree that the disposable liner 100 has never been used.

Figure 9:
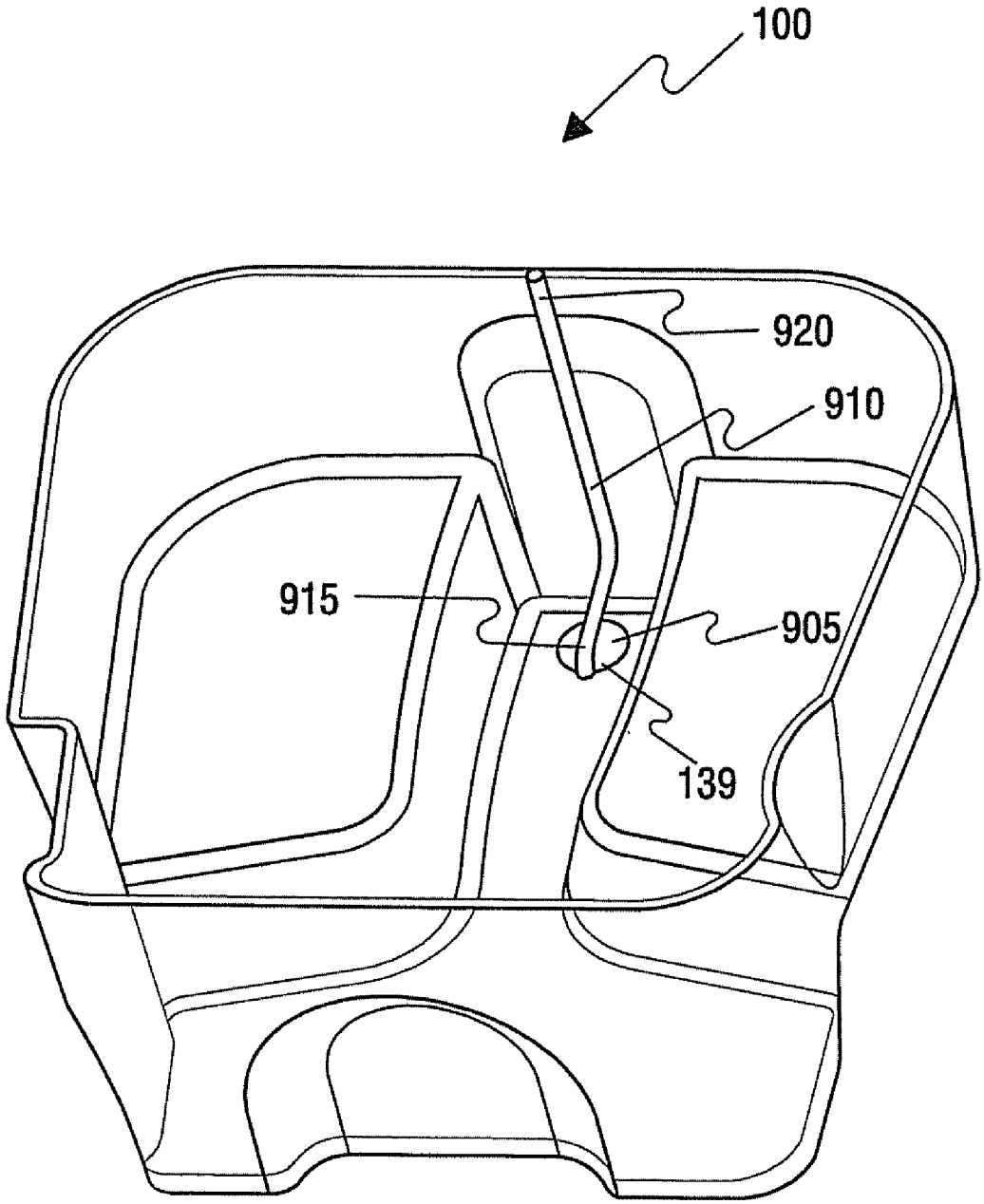
FIG. 9 is a perspective view of a disposable liner such as that shown in FIG. 1, having an extended member on a cover of the disposable liner.

FIG. 9 is a perspective view of a disposable liner 100 such as that shown in FIG. 1, having an extended member 910 on a cover 905 of the disposable liner. The cover 905 is placed over the drainage hole 139 of the disposable liner 100, preventing water from draining out of the disposable liner 100. The cover 905 further includes an elongated tab 910 having a distal end 915 and proximal end 920. The distal end 915 of the elongated tab 910 is positioned away from the sidewall 113 of the disposable liner 100 and the proximal end 920 is placed adjacent to the top edge of the sidewall 113. The elongated tab 910 can be glued or heat sealed to the sidewall 113 along a portion of the elongated tab 910.

Alternatively or additionally, the elongated tab can be made by the same material as the cover or a string (not shown) attached to the cover 905. Alternatively or additionally, the proximal end 920 can be attached to a floater that can float on top of the water. The elongated tab 910 aids a user to easily unseal the cover 905 from the drainage hole 139. In addition, a user can unseal the cover 905 without touching the water inside the disposable liner 100, preventing potential bacteria infections to the user.

This description has been presented for purposes of illustration and description. It is not intended to be exhaustive or to limit the disclosure to the precise forms disclosed. Obvious modifications or variations are possible in light of the above teachings. The embodiments discussed, however, were chosen to illustrate the principles of the disclosure, and its practical application. The disclosure is thus intended to enable one of ordinary skill in the art to use the disclosure, in various embodiments and with various modifications, as are suited to the particular use contemplated. All such modifications and variation are within the scope of this disclosure, as determined by the appended claims when interpreted in accordance with the breadth to which they are fairly and legally entitled.

The invention claimed is:

1. A disposable liner that is disposed in a cavity of a basin comprising:

sidewalls that are designed to adapt to contours of the cavity of the basin;

a bottom wall that is attached to the sidewalls and includes a drainage hole that is aligned with the drainage hole of the basin, an inner surface of the bottom wall further including footrests that are attached in a normal position to at least one of the sidewalls and a trench that is formed between the footrests; and a cover that seals the drainage hole, which prevents water from draining out of the disposable liner through the drainage hole, the cover including an elongated tab that extends to a top edge of at least one of the sidewalls, the elongated tab being designed to facilitate peeling the cover off the disposable liner.

2. The disposable liner as defined in claim 1, wherein the elongated tab is made by the same material as the cover.

3. The disposable liner as defined in claim 1, wherein the elongated tab is a string attached to the cover.

4. The disposable liner as defined in claim 1, wherein the elongated tab includes a floater that can float on top of the water.

5. The disposable liner as defined in claim 1, wherein the cover includes a heat sealed foil that is a non-contact method of heating a metallic disk to hermetically seal the drainage hole using an induction sealing method.

* * * * *